US006764348B2

(12) United States Patent
Han et al.

(10) Patent No.: US 6,764,348 B2
(45) Date of Patent: Jul. 20, 2004

(54) MODULAR JACK

(75) Inventors: Chang Roul Han, Seoul (KR); Sang Hyouk Lee, Seoul (KR)

(73) Assignee: Dae Eun Electronics Co., Ltd., Anyang-si (KR)

( * ) Notice: Subject to any disclaimer, the term of this patent is extended or adjusted under 35 U.S.C. 154(b) by 0 days.

(21) Appl. No.: 10/387,758

(22) Filed: Mar. 13, 2003

(65) Prior Publication Data

US 2004/0102099 A1 May 27, 2004

(30) Foreign Application Priority Data

Nov. 21, 2002 (KR) ..... 10-2002-0072829

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS 5,178,563 A * 1/1993 Reed ..... 439/676

5,626,497 A * 5/1997 Bouchan et al. ..... 439/676

* cited by examiner

*Primary Examiner*—Ross Gushi
(74) *Attorney, Agent, or Firm*—Volpe and Koenig, P.C.

(57) ABSTRACT

Disclosed relates a modular jack that can be manufactured simply with small size and reduce cross talk induced from the plug satisfactorily. The modular jack includes a housing for receiving a plug and an insert for electrically connecting to the plug. The insert includes first and second conductors of first to fourth signal pairs, the first and second conductors of the first, second and fourth signal pair [T1, R1], [T2 and R2] and [T4 and R4], adjacent to the first and second conductors of the third signal pair [T3 and R3], are intersected with each other in a multi-layered wiring structure to generate inductive cross talk having a reverse phase against cross talk that arises from the plug, thus canceling the cross talk. Besides, the first and second conductors of signal pair [T1, R1], [T2 and R2] and [T4 and R4] are arranged to make an angle of 90 degree at a crossing surface between the first and second conductors to minimize the inductive cross talk that occurs due to the crossing arrangement.

12 Claims, 9 Drawing Sheets

MODULAR JACK

BACKGROUND OF THE INVENTION

1. Field of the Invention

The present invention relates to an electrical connector comprised of a modular jack and a plug, more particularly to a modular jack that can be manufactured simply with small size and reduce cross talk induced from the plug satisfactorily.

2. Description of the Related Art

Referring to FIG. 1, showing an electrical connector including a commonly available RJ45 type modular jack 1 and its associated plug 2, the modular jack 1 including a housing 11 and a substrate 12 mounted into the housing 11. Insert 13 is mounted on an end of the substrate 12 and a connecting terminal 14 for electrically connecting to an external cable on an opposite end of the substrate 12. Insert 13 includes connecter pins 13*a* and a body 13*b*. Connecter pins 13*a* penetrating the body 13*b* electrically connect to the substrate 12 at the rear of the body 13*b*. Besides, predetermined electrical paths are provided on the top and rear sides of the substrate 12, thus appropriately coupling the connecter pins 13*a* to the connecting terminal 14.

Plug 2 includes guide grooves 21, for guiding the connector pins 13*a* in a position corresponding to the connector pins 13*a*, and contacts, not depicted, electrically connected to a cable 22 in the guide grooves 21. Accordingly, when the plug 2 is inserted to the housing 11 of modular jack 1, the connecter pins 13*a* of modular jack 1 are electrically coupled to the contacts of plug 2.

Next, referring to FIGS. 2 and 3, there are provided four signal pairs comprised of conductors [R1 and T1], [R2 and T2], [R3 and T3], and [R4 and T4], respectively. In general, cross talk arises due to capacitive and inductive couplings between adjacent conductors, not between each of the signal pairs. Accordingly, adjacent conductors, which are not a single pair in themselves, are referred to as a cross-talking pair. That is, conductors [T1 and R3], [R3 and T2], [R2 and T3], and [T3 and R4] form cross-talking pairs, respectively.

Here, it is known that the cross talk induced within each of the cross-talking pairs [T1 and R3] and [T3 and R4] may be substantially cancelled by reverse phase capacitive coupling, a well-known method in the art. However, the inventor of the present invention has found that the cross talk which occurs within each of the cross-talking pairs [R3 and T2] and [R2 and T3] may not be sufficiently cancelled by the capacitive coupling. Thus, it is considered that the cross talk which arises within each of the cross-talking pairs [R3 and T2] and [R2 and T3] may be substantially affected by the inductive coupling rather than the capacitive coupling. In effect, the inventor has noted that a substantial amount of magnetic field is induced between the signal pair [T2 and R2] as shown in FIG. 3 with arrows.

Meanwhile, the induced magnetic filed generates electric current between the signal pairs, and the induced current corresponds to a noise signal against the original signal transmitted through the signal pair [T2 and R2]. Accordingly, it is necessary to provide a method for reducing cross talk induced from the modular jack 1 connected to the plug 2. Recently, there have been applied a method for forming a predetermined circuit on the substrate 12 of modular jack 1 to reduce cross talk. That is, the connector pins 13*a* are soldered on the substrate 12 where a predetermined circuit corresponding to the respective conductors of the connector pins 13*a* is formed. Here, it is necessary to consider electromagnetic variations, such as thickness and length of conductors, intervals between conductors, etc., in the circuit sufficiently to reduce the capacitive and inductive cross talk generated between adjacent conductors. However, since the size of substrate 12 is limited to the extent that it is inserted to the housing 11 of modular jack 1, it is required to design precisely the respective patterns corresponding to eight conductors, for example, on the small-sized substrate 12.

Besides, since the conventional modular jack 1 includes the substrate 12 for reducing cross talk as described above, it is necessary to have the additional connecting terminal 14 for electrically connecting to an external device, such as a communication cable or printed circuit board of communication equipment, etc., which has drawbacks in reducing the overall size of the modular jack to meet the recent trend of miniaturization of communication equipments, and simplifying the manufacturing process as well.

BRIEF SUMMARY OF THE INVENTION

Accordingly, the present invention is directed to a modular jack that can be manufactured simply with small size and reduce cross talk induced from the plug satisfactorily.

To accomplish an object of the present invention, there is provided a modular jack, connected to a plug including first to fourth signal pairs having first and second conductors respectively, the second signal pair being placed between the first and second conductors of the third signal pair, the modular jack comprising a housing for receiving the plug; and an insert for electrically connecting to the plug, the insert, assembled with the housing, including first to fourth signal pairs having first and second conductors respectively, the respective conductors of the first, second and fourth signal pairs adjacent to the first and second conductors of the third signal pairs being arranged cross to each other.

To accomplish another object of the present invention, the insert includes connector pins, electrically connected to the first to fourth signal pairs of the plug, having first to fourth signal pairs, and first and second portions, bent rectangularly, for fixing the connector pins, the first portion forming an upper side of the housing and the second portion forming a lateral side of the housing.

To accomplish another object of the present invention, the insert includes a first insert, having first connector pins having first conductors of the first to fourth signal pairs, first and second bodies for fixing the first connector pins; and a second insert, having second connector pins having second conductors of the first to fourth signal pairs, third and fourth bodies for fixing the second connector pins, the first body of the first insert and the third body of the second insert forming the first portion of the insert, and the second body of the first insert and the fourth body of the second insert forming the second portion of the insert, thus forming a multi-layered wiring structure.

To accomplish another object of the present invention, the first portion of the insert includes shelves formed on both edges thereof and the second portion of the insert has lockers on both lateral sides thereof, and the housing includes guide bars formed on both sides of an upper part thereof for assembling slidably with the shelves, and locking grooves formed on both lateral sides thereof for receiving the lockers.

To accomplish another object of the present invention, the connector pins are bent on a front edge of the first portion of the insert, and the housing includes a first guide groove for guiding the connector pins bent on the front edge of the first portion of the insert and a second guide groove for guiding connector pins located on a rear edge of the second portion of the insert.

To accomplish another object of the present invention, the first and second conductors of the first, second and fourth signal pairs are intersected with each other in the first portion, and the first and second conductors of the first and second signal pairs are arranged adjacent to an outside of the insert, having a multi-layered wiring structure.

To accomplish another object of the present invention, the first and second conductors of the second signal pair are intersected with each other twice in the first portion.

To accomplish another object of the present invention, the first and second conductors of the first, second and fourth signal pairs are disposed to make an angle of 90 degree at a crossing surface between the first and second conductors.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
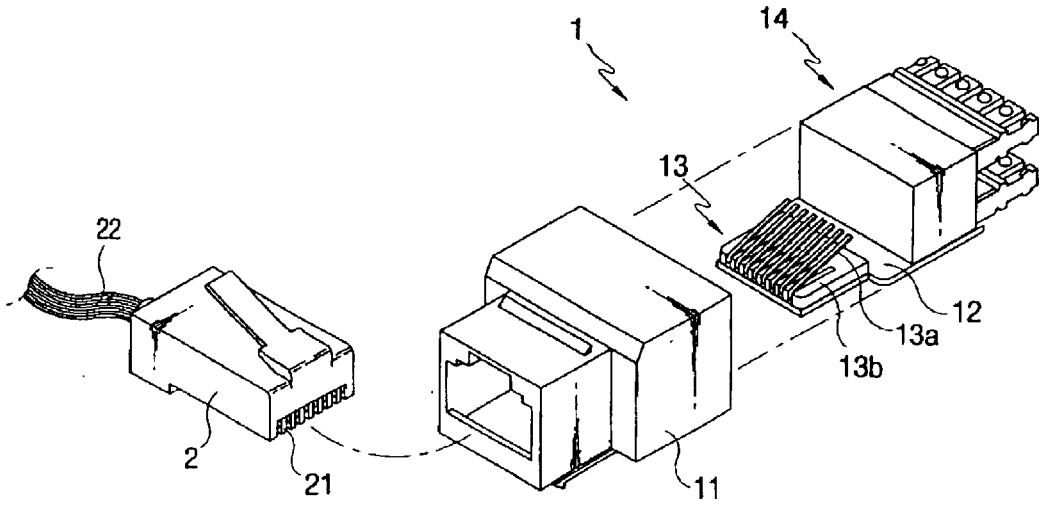
Fig. 1 PRIOR ART
FIG. 1 is a perspective view showing a commonly available modular jack and its associated plug.
Figure 2:
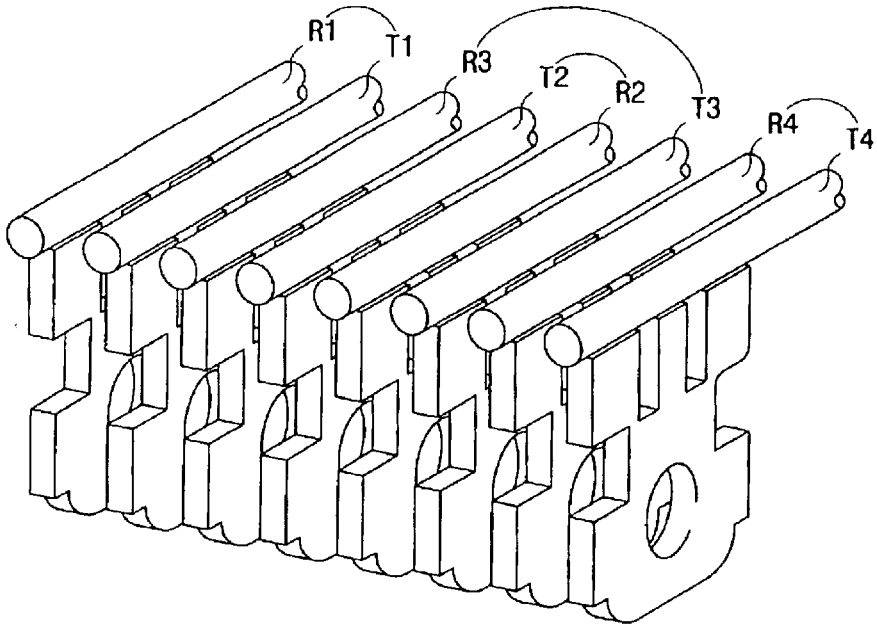
Fig. 2 PRIOR ART
FIG. 2 is an enlarged perspective view showing an arrangement of contacts of plug depicted in FIG. 1.
Figure 3:
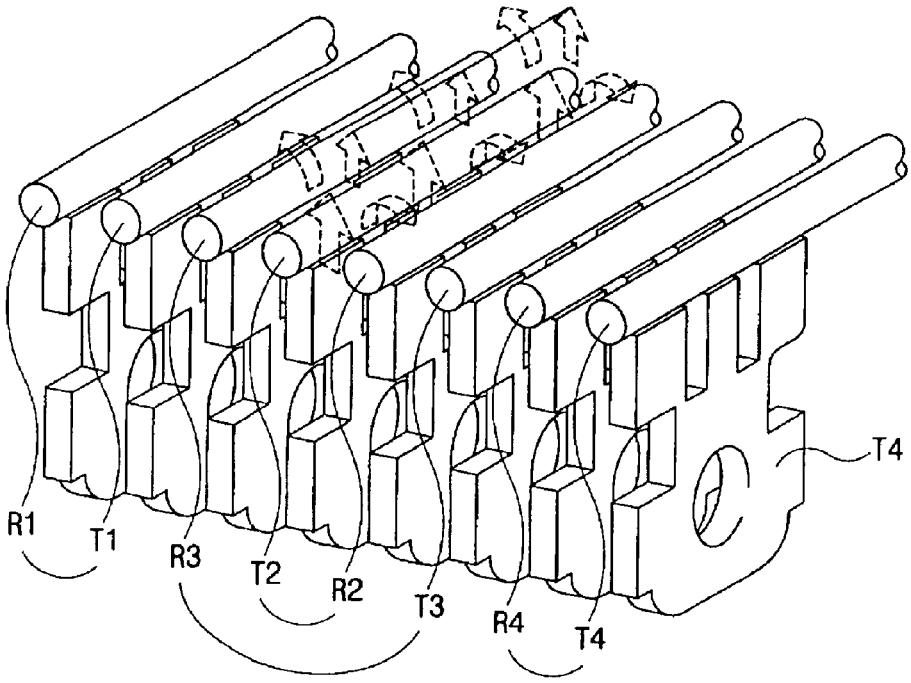
Fig. 3 PRIOR ART
FIG. 3 is an explanatory view showing how magnetic fields are released from the contacts of plug in FIG. 1.
Figure 4:
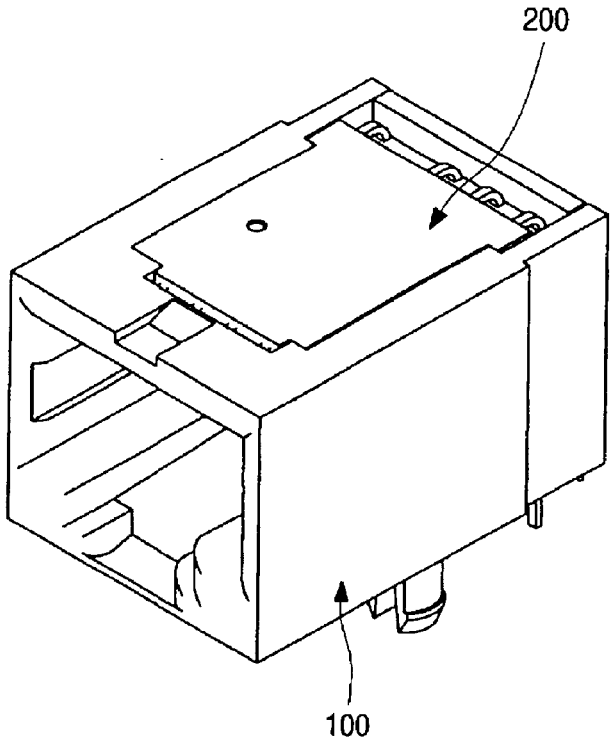
FIG. 4 is a perspective view showing an assembled modular jack in accordance with the present invention.
Figure 5:
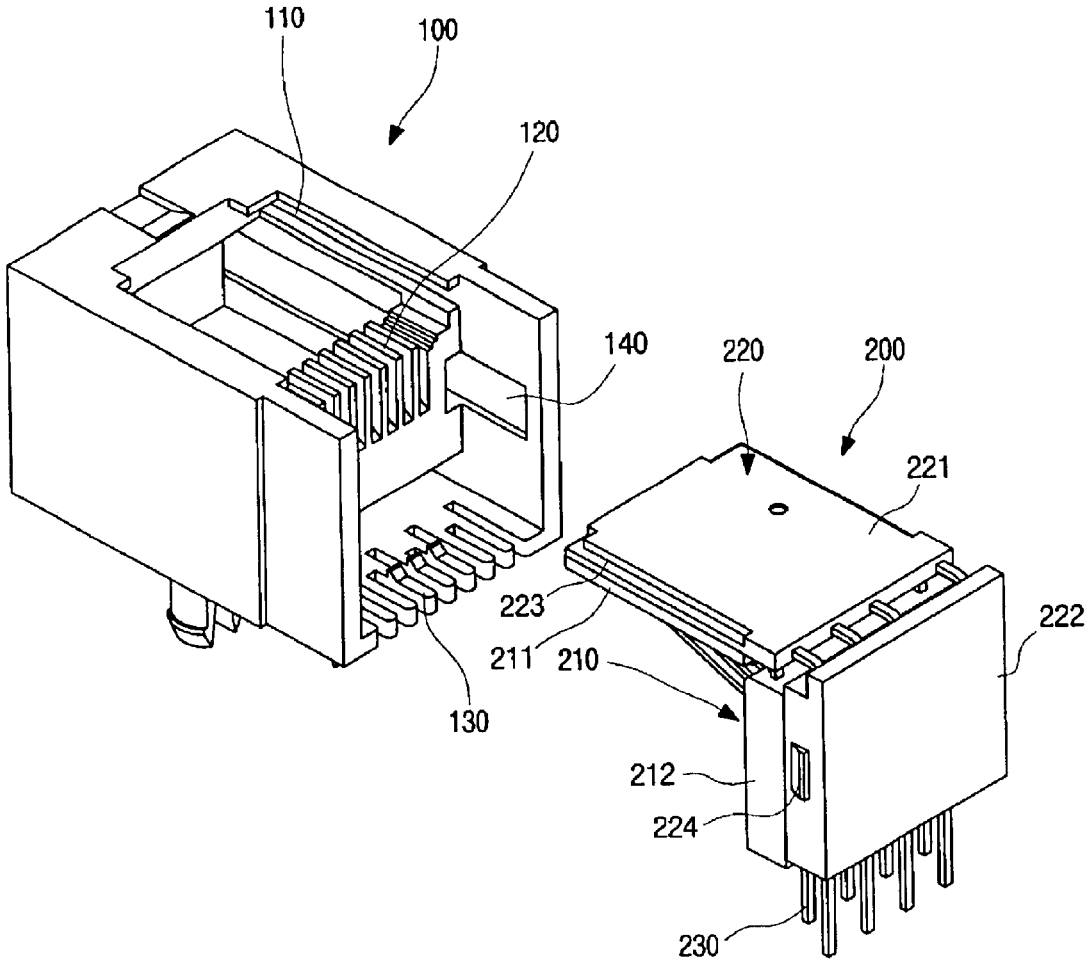
FIG. 5 is a perspective view showing a disassembled modular jack of the invention.

Now, referring to FIGS. 4 and 5, a modular jack of the present invention includes a housing 100 for receiving a plug, not depicted, and an insert 200 connecting electrically to the plug, in the form of surface mounted device (SMD). The insert 200 assembled with the housing 100 forms an upper side and a lateral side of the modular jack.

Figure 6A:
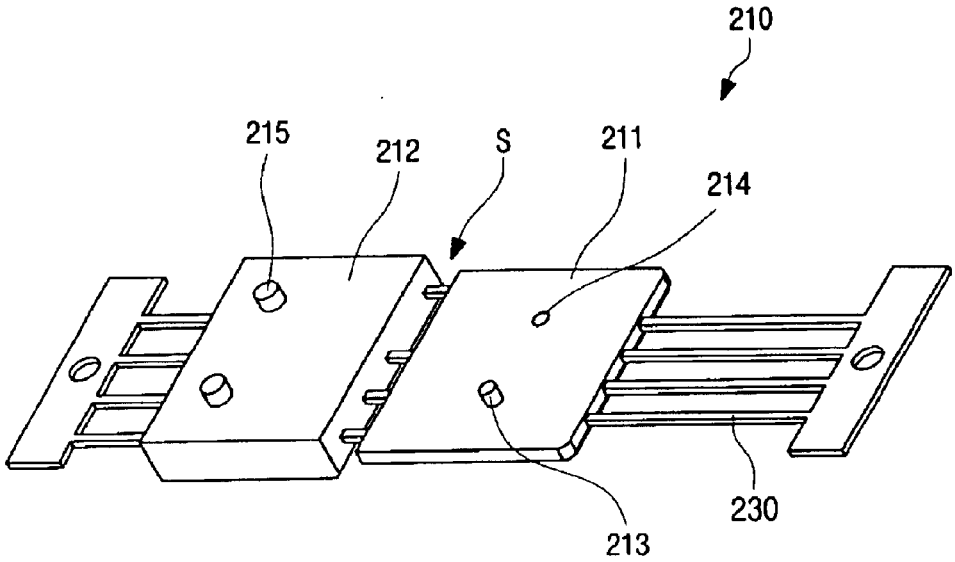
FIGS. 6*a*, 6*b* and 7 are perspective views illustrating a structure of insert depicted in FIGS. 4 and 5.
Figure 6B:
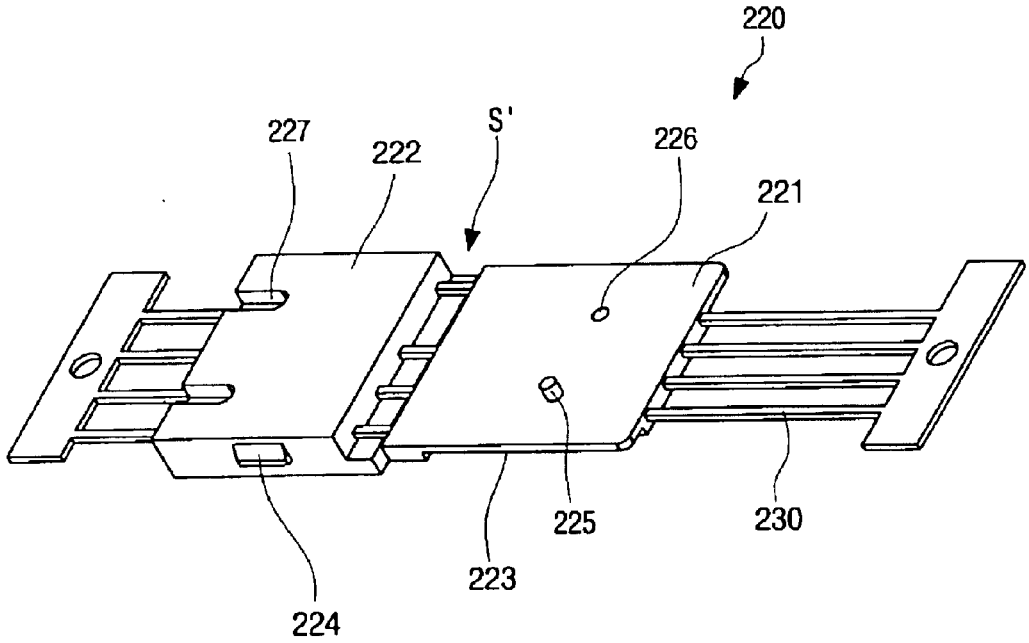
Figure 7:
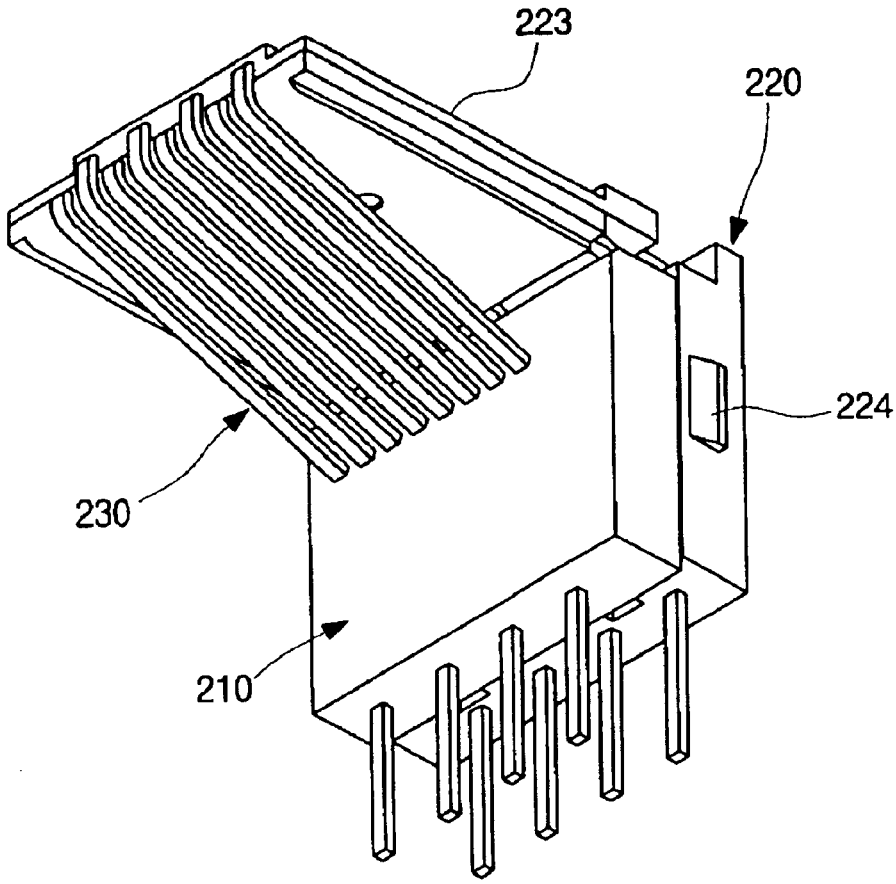

Next, referring to FIGS. 6*a* and 6*b*, the insert 200 is composed of a first insert 210 of FIG. 6*a* and a second insert 220 of FIG. 6*b*. The first and second inserts 210 and 220 include first and second bodies [211, 221] and [212, 222], made of synthetic resin, for example, through which connector pins 300 are penetrated. There are formed shelves 223 on both edges of the first body 221 and lockers 224 on both lateral sides of the second body 222 of the second insert 220, respectively, for matching with an upper part of the housing 100, as shown in FIG. 5. Besides, there are provided assembling projections 213 and 225, assembling grooves 214 and 226, guide projections 215 and guide grooves 215 as shown in FIGS. 6*a* and 6*b*. The assembling projection 213 formed on the first body 211 of first insert 210 is assembled with the assembling groove 226 formed on the first body 221 of second insert 220; on the contrary, the assembling projection 225 on the first body 221 of second insert 220 is assembled with the assembling groove 214 on the first body 211 of first insert 210. Two guide projections 215 formed on the second body 212 of first insert 210 are combined with two guide grooves 227 on the second body 222 of second insert 220. Since the first insert 210 is located inward after the assembled first and second inserts 210 and 220 are bent, an interval S between the first and second bodies 211 and 212 of first insert 210 is set shorter than another interval S' between the first and second bodies 221 and 222 of second insert 220, which facilitates the rectangular bending of the first and second inserts 210 and 220.

Meanwhile, returning to in FIG. 5, the housing 100 includes guide bars 110, formed on both sides of the upper part thereof, for connecting slidably with the shelves 223 of the second insert 220. First and second guide grooves 120 and 130 for guiding the connector pins 230 of insert 200, and locking grooves 140, formed on both lateral sides of the second body 222 of the second insert 220, for receiving the lockers 224 are provided inside the housing 100. Here, the first guide groove 120 is to guide the connector pins 230 extruded from the first bodies 211 and 221, whereas the second guide groove 130 is to guide the connector pins 230 extended from the second bodies 212 and 222. The connector pins 230 guided through the second guide groove 130 are connected directly with the external device.

The insert 200 has specific arrangements of connector pins 230 for reducing cross talk induced in the plug. That is, the first portion including the first bodies 211 and 221 of the insert 200 has an arrangement of connector pins having reverse phase between signal pairs for minimizing cross talk, and the second portion including the second bodies 212 and 222 of the insert 200 has another pin arrangement of connector pins having sufficient intervals between adjacent signal pairs for preventing additional generation of cross talk.

Figure 8A:
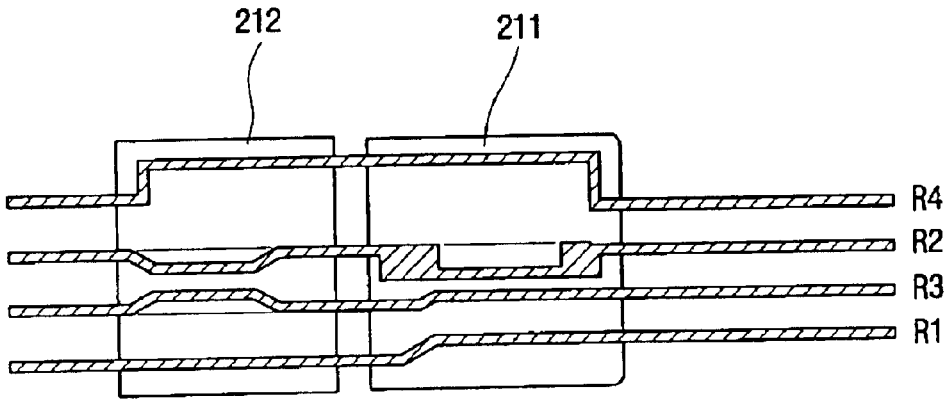
FIGS. 8*a* and 8*b* show arrangements of connector pins of first and second inserts depicted in FIGS. 6*a* and 6*b;*
Figure 8B:
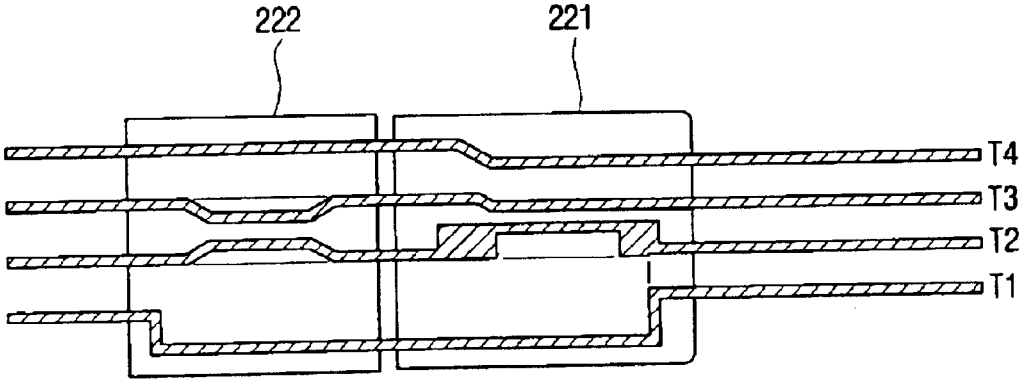

Referring to FIGS. 8*a* and 8*b*, FIG. 8*a* shows an arrangement of connector pins of the first insert 210 including conductors [R1, R3, R2 and R4], and FIG. 8*b* depicts another arrangement of connector pins of the second insert 220 having conductors [T1, T2, T3 and T4]. Conductors [R1, R3, R2 and R4] of the first insert 210 and conductors [T1, T2, T3 and T4] of the second insert 220 are arranged opposite to each other. That is, in the first insert 210, conductor R1 is bent diagonally in the first body 211 and goes straight in the second body 212, conductor R4 is bent right rectangularly in the first body 211 and bent left rectangularly in the second body 212, and conductor R2 and R3 are arranged in a manner that specific portions are bent and placed adjacent and parallel to each other. In the second insert 220, conductor T1, placed opposite to conductor R4 of the first insert 210, is bent left rectangularly in the first body 221 and bent right rectangularly in the second body 222, conductor T4, located opposite to conductor R1 of the first insert 210, is bent diagonally in the first body 221 and goes straight in the second body 222, and conductors T3 and T2 are arranged opposite to conductor R2 and R3 respectively.

Figure 9:
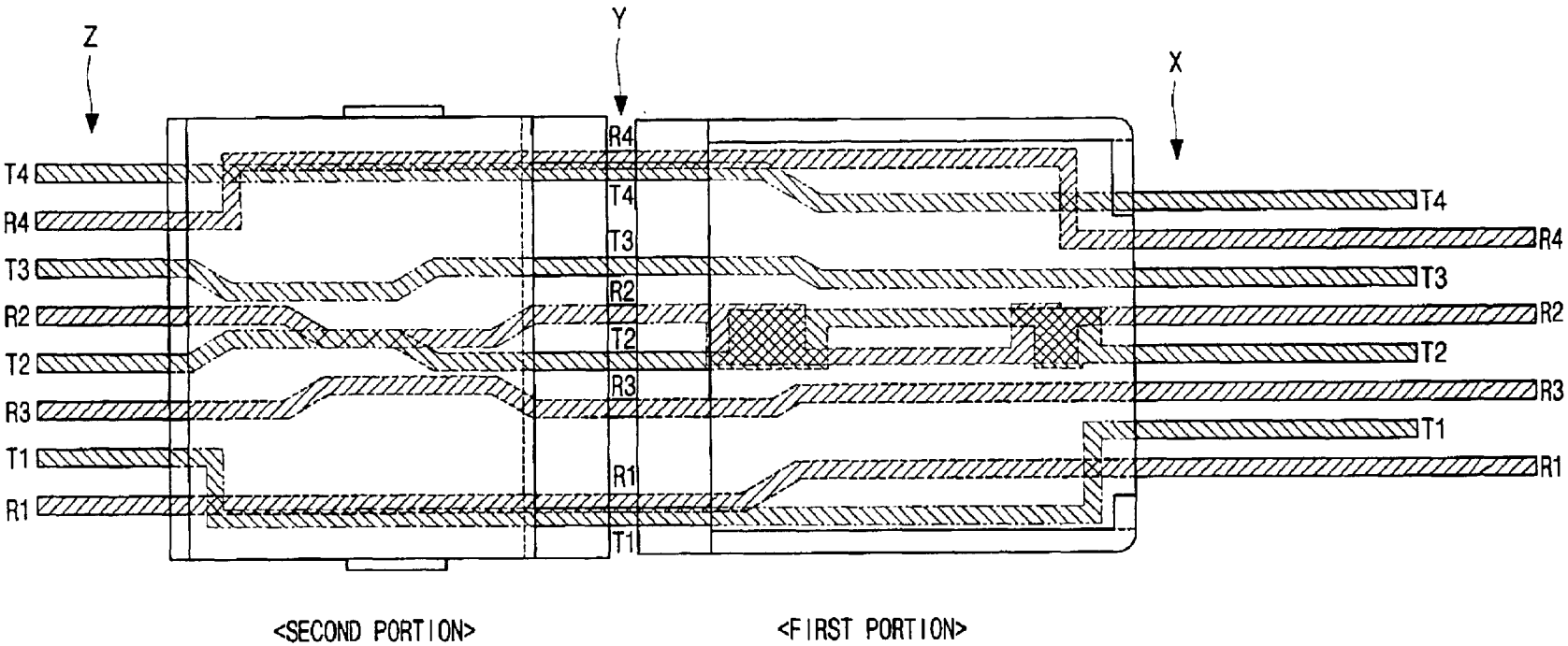
FIG. 9 shows a plane arrangement of assembled connector pins of first and second inserts depicted in FIGS. 8*a* and 8*b;*

Next, referring to FIG. 9 showing a plane arrangement of assembled connector pins of first and second inserts 210 and 220 described with reference to FIGS. 8*a* and 8*b*, reference mark X denotes a portion that is connected with the first guide groove 120 of the housing 100 for electrically connecting to the plug, where conductors R1, T1, R3, T2, R2, T3, R4 and T4, are arranged in order. Reference mark Y denotes a point where conductors T1, R1, R3, T2, R2, T3, T4, and R4 are arranged in order and are bent. Reference mark Z denotes a portion that is connected with the second guide groove 130 of the housing 100 for electrically connecting to external device where conductors R1, T1, R3, T2, R2, T3, R4, and T4 are located in order.

Figure 10A:
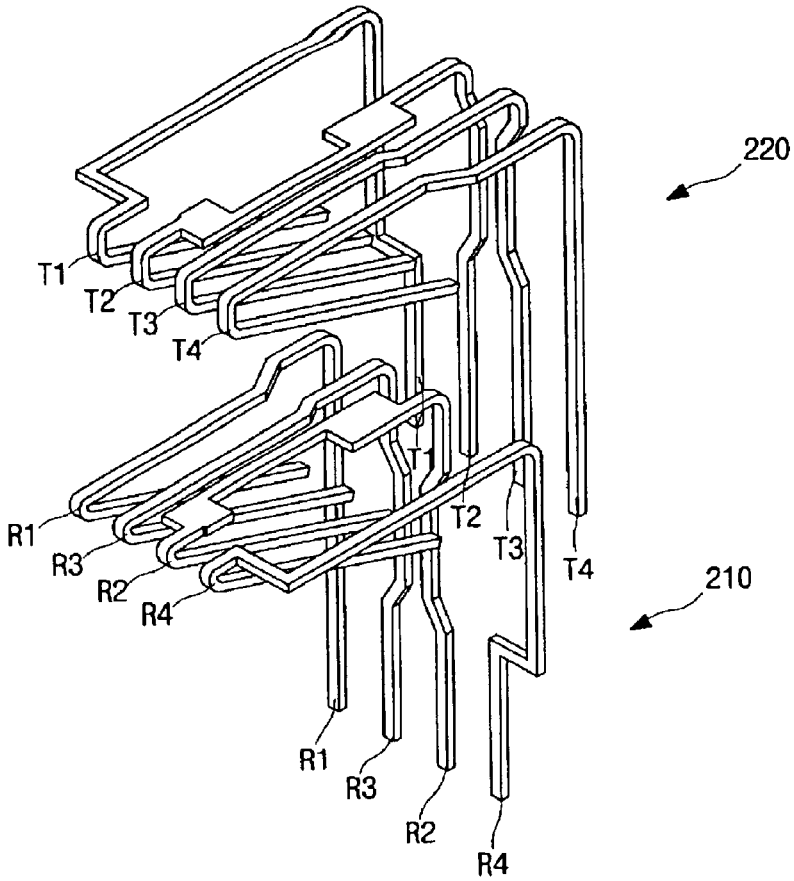
FIGS. 10*a* and 10*b* illustrate three-dimensional arrangements of connector pins of first and second inserts depicted in FIGS. 8*a* and 8*b;*
Figure 10B:
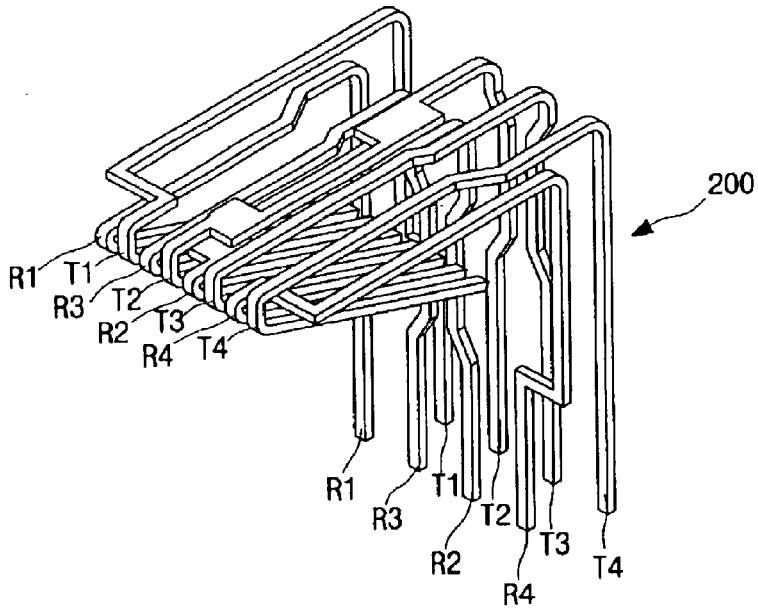
Figure 11:
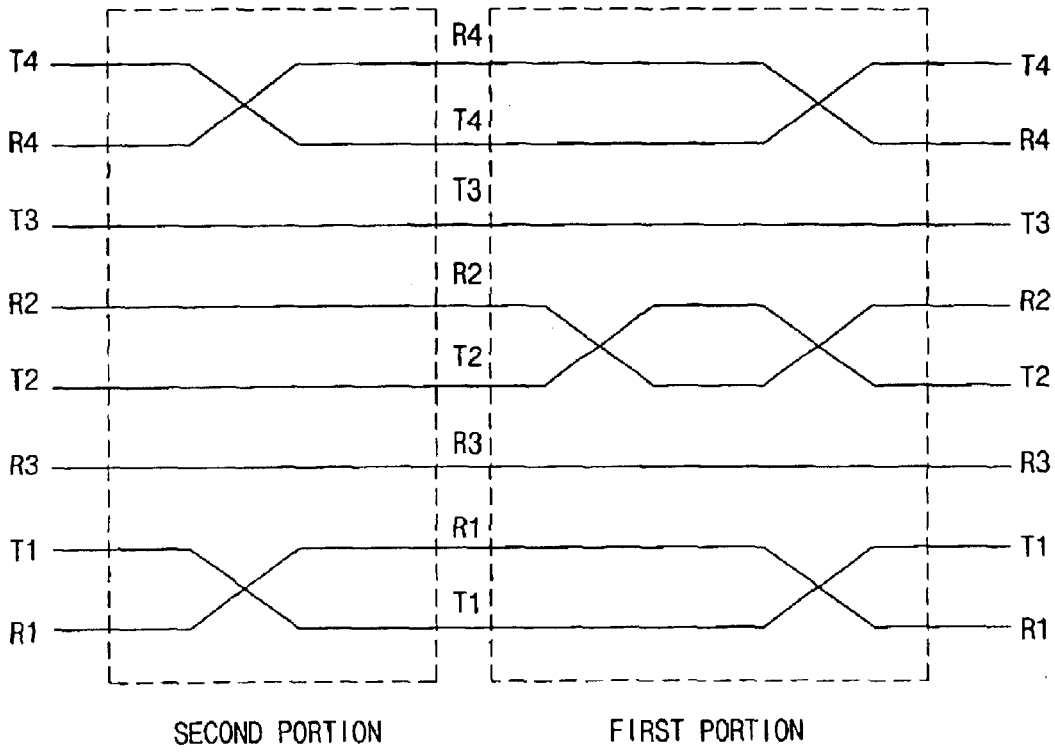
FIG. 11 shows a crossing arrangement of connector pins of first and second inserts in FIGS. 9, 10*a* and 10*b*.

Meanwhile, FIGS. 10*a* and 10*b* illustrate three-dimensional arrangements of conductors [R1, R3, R2 and R4] of the first inserts 210 and conductors [T1, T2, T3 and T4] of the-second insert 220, FIG. 10*b* showing how the first and second inserts 210 and 220 are assembled. The insert 200 has an arrangement of connector pins, where conductors of signal pair [T1 and R1], [T2 and R2] and [T4 and R4] are intersected with each other in the first portion. Here, the conductors [T2 and R2] of signal pair are intersected with each other twice in the first portion. FIG. 11 shows how the respective conductors of signal pairs are intersected with each other. With reference to FIGS. 9 and 11, it can be seen that the conductors T1 and R4 are arranged adjacent to the outside of the insert 200, keeping a sufficient distance from signal pairs [T3 and R3] and [T2 and R2]. This variation of conductors' location makes the distances between the conductors varied, thus changing capacitor C between conductors. Accordingly, it is possible to compensate for the capacitive cross talk, induced from the plug, in the insert 200 by regulating the distances between conductors. Besides, the conductors of signal pair [T2 and R2] and [T3 and R3] are arranged to have a reverse phase magnetic coupling, thus attenuating the inductive cross talk, which arises from the plug, in the insert 200 as shown in FIG. 11.

Figure 12:
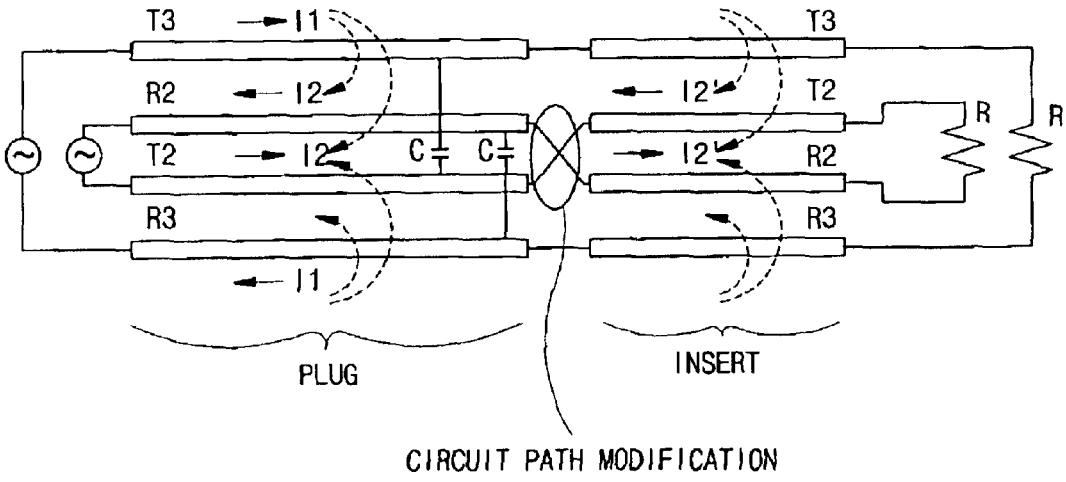
FIG. 12 is a schematic diagram illustrating a cross talk reduction principle according to a crossing arrangement of signal pairs in accordance with the present invention.

Here, the principle of reducing cross talk according to the crossing arrangement of signal pairs will be described hereinafter with reference to FIG. 12. That is, when applying electric current 11 to the signal pair [T3 and R3], electric current 12 is induced through the signal pair [T2 and R2] accordingly. Reference mark R denotes a terminal resistance, corresponding to a communications terminal. In the same manner, when applying electric current 12 to the signal pair [T3 and R3], electric current 12' is introduced through the signal pair [T2 and R2]. Here, since the conductors of signal pair [T2 and R2] is arranged cross against the conductors of signal pair [T3 and R3] in the plug and insert, the induced currents 12 and 12' of the signal pair [T2 and R2] are directed reverse to each other. Thus, The induced currents 12 and 12' are cancelled with each other to prevent the generation of cross talk in the plug.

Besides, the conductors of signal pair [T1 and R1], [T2 and R2] and [T4 and R4] are disposed to make an angle of 90 degree at a crossing surface between the corresponding conductors, thus minimizing the inductive cross talk, which arises due to the crossing arrangement of the conductors. In this embodiment, since the insert 200 having a rectangular shape is used as a part of the housing 100, it is possible to manufacture the modular jack of the present invention simply with small size. Here, it is practicable to make the bending portion S and S' of the insert 200 round to minimize cross talk from the bending portion.

According to the preferred embodiment of the present invention, it is possible to minimize the inductive cross talk, which arises from the plug, by intersecting the conductors of signal pair [T1 and R1], [T2 and R2] and [T4 and R4] with each other, respectively.

Furthermore, with the respective conductors [R1 to R4, T1 to T4] arranged in a multi-layered wiring structure in the insert 200, conductors T1 and R1, conductors T2 and R2, and conductors T4 and R4 are positioned opposite to each other in order to make the conductors capacitive couplings. Accordingly, the capacitive cross talk induced by the capacitive couplings between the cross-talking pairs [T1 and R3], [R3 and T2], [R2 and T3] and [T3 and R4] can be cancelled.

According to the present invention, there can be provided a modular jack that can be manufactured simply with small size and reduce cross talk induced from the plug satisfactorily.

It will be apparent to those skilled in the art that various modifications and variations can be made in the modular jack of the present invention without departing from the spirit or scope of the invention. Thus, it is intended that the present invention cover the modifications and variations of this invention provided they come within the scope of the appended claims and their equivalents.

What is claimed is:

1. A modular jack for connecting to a plug having first to fourth signal pairs, each signal pair having first and second conductors respectively, the second signal pair placed between the first and second conductors of the third signal pair, wherein the modular jack comprises:

a housing for receiving the plug;

an insert for electrically connecting to the plug, the insert, assembled with the housing, including first to fourth signal pairs having first and second conductors respectively, the respective conductors of the first, second and fourth signal pairs adjacent to the first and second conductors of the third signal pairs being arranged cross to each other and wherein the insert includes connector pins, electrically connected to the first to fourth signal pairs of the plug, having first to fourth signal pairs, and first and second portions, bent rectangularly, for fixing the connector pins, the first portion forming an upper side of the housing and the second portion forming a lateral side of the housing; and the insert including:

a first insert, having first connector pins having first conductors of the first to fourth signal pairs, first and second bodies for fixing the first connector pins; and a second insert, having second connector pins having second conductors of the first to fourth signal pairs, third and fourth bodies for fixing the second connector pins, the first body of the first insert and the third body of the second insert forming the first portion of the insert, and the second body of the first insert and the fourth body of the second insert forming the second portion of the insert, thus forming a multi-layered wiring structure.

2. The modular jack as recited in claim 1, wherein the first portion of the insert includes shelves formed on both edges thereof and the second portion of the insert has lockers on both lateral sides thereof, and the housing includes guide bars formed on both sides of an upper part thereof for assembling slidably with the shelves, and locking grooves formed on both lateral sides thereof for receiving the lockers.

3. The modular jack as recited in claim 2, wherein the connector pins are bent on a front edge of the first portion of the insert, and the housing includes a first guide groove for guiding the connector pins bent on the front edge of the first portion of the insert and a second guide groove for guiding connector pins located on a rear edge of the second portion of the insert.

4. The modular jack as recited in claim 1, wherein the first and second conductors of the first, second and fourth signal pairs are intersected with each other in the first portion, and the first and second conductors of the first and second signal pairs are arranged adjacent to an outside of the insert, having a multi-layered wiring structure.

5. The modular jack as recited in claim 4, wherein the first and second conductors of the second signal pair are intersected with each other twice in the first portion.

6. The modular jack as recited in claim 4, wherein the first and second conductors of the first, second and fourth signal pairs are disposed to make an angle of 90 degrees at a crossing surface between the first and second conductors.

7. A modular jack, comprising a housing for receiving a plug and an insert for electrically connecting to the plug, wherein the modular jack connected to the plug includes first to fourth signal pairs having first and second conductors respectively, the second signal pair being placed between the first and second conductors of the third signal pair, wherein said insert comprises a first insert and a second insert forming a multi-layered wiring structure, wherein the first insert comprises a first body and a second body spaced a small distance apart for fixing a first connector pin comprising the first conductor of the first to fourth signal pairs, and wherein the second insert comprises a first body and a second body spaced a small distance apart for fixing a second connector pin comprising the second conductor of the first to fourth signal pairs, said connector pins between the first and second bodies each bent rectangularly and the first body forming an upper side of the housing and the second body forming a lateral side of the housing.

8. The modular jack of claim 7, wherein the first body of the insert includes shelves formed on both edges thereof and the second body of the insert has lockers on both lateral side thereof, and the housing includes guide bars formed on both sides of an upper part thereof for assembling slidably with the shelves, and locking grooves formed on both lateral sides thereof for receiving the lockers.

9. The modular jack of claim 8, wherein the connector pins are bent on a front edge of the first body of the insert, and the housing includes a first guide groove for guiding the connector pins bent on the front edge of the first body of the insert and a second guide groove for guiding connector pins located on a rear edge of the second body of the insert.

10. The modular jack of claim 7, wherein the first and second conductors of the first, second and fourth signal pairs are intersected with each other in the first body, and the first and second conductors of the first and fourth signal pairs are arranged adjacent to an outside of the second body, having a multi-layered wiring structure.

11. The modular jack of claim 10, wherein the first and second conductors of the second pair are intersected with each other twice in the first portion.

12. The modular jack as recited in claim 10, wherein the first and second conductors of the first, second and fourth signal pairs are disposed to make an angle of 90 degrees at a crossing surface between the first and second conductor.

* * * * *